United States Patent [19]

Lemke

[11] 4,435,254

[45] Mar. 6, 1984

[54] BRIGHT NICKEL ELECTROPLATING

[75] Inventor: Kenneth W. Lemke, Englishtown, N.J.

[73] Assignee: M&T Chemicals Inc., Woodbridge, N.J.

[21] Appl. No.: 272,850

[22] Filed: Jun. 12, 1981

Related U.S. Application Data

[63] Continuation of Ser. No. 88,610, Oct. 26, 1979, abandoned, which is a continuation of Ser. No. 956,741, Nov. 1, 1978, abandoned.

[51] Int. Cl.[3] ..... C25D 3/14; C25D 3/16; C25D 3/18

[52] U.S. Cl. ..... 204/49

[58] Field of Search ..... 204/49, 43 T, 112

[56] References Cited

U.S. PATENT DOCUMENTS 4,077,855 3/1978 Popescu ..... 204/49

FOREIGN PATENT DOCUMENTS 1023201 3/1966 United Kingdom ..... 204/49

*Primary Examiner*—G. L. Kaplan

*Attorney, Agent, or Firm*—S. A. Marcus; F. Schoenberg; S. H. Parker

[57] ABSTRACT

In accordance with certain of its aspects this invention relates to a process and composition for the preparation of a nickel electrodeposit, which comprises passing current from an anode to a cathode through an aqueous acidic electroplating solution containing at least one member selected from nickel compounds; the improvement comprising the presence of (i) an acetylenic amine or substituted amine, aliphatic or aromatic; and (ii) a sulfonated acetylenic and salts thereof where the acetylenic bond and the sulfonate radical are connected by a carbon chain where C=1-6;

for a time period sufficient to form a metal electroplate upon said cathode.

46 Claims, No Drawings

BRIGHT NICKEL ELECTROPLATING

This is a continuation of application Ser. No. 088,610 filed Oct. 26, 1979 and now abandoned, which in turn was a continuation of application Ser. No. 956,741 filed Nov. 1, 1978 and now abandoned.

BACKGROUND OF THE INVENTION

To conserve nickel and reduce costs, a number of procedures have been adopted by the nickel plating industry. Some of these procedures include reducing the thickness of the nickel deposited, substituting cobalt for some or all of the nickel when cobalt is less expensive or more readily available, and more recently electrodepositing nickel-iron, cobalt-iron, or nickel-cobalt-iron alloys in which as much as 60% of the deposit may consist of relatively inexpensive iron.

However, when deposit thickness is reduced, it is necessary to use more effective or "powerful" nickel brighteners or higher concentrations of nickel brighteners, so that the degree of brightening and leveling to which the nickel plating industry has grown accustomed may be obtained. The more "powerful" nickel brighteners or high concentrations of brighteners, while capable of producing the desired brightening and leveling, may nevertheless cause unacceptable side effects. The deposits may peel or may be highly stressed, severely embrittled, less receptive to subsequent chromium deposits or exhibit hazes, reduced low current density covering power or "throw" or striations and skip plate i.e.; areas in which a deposit is not obtained.

In order to overcome the deleterious effects of "powerful" brighteners or high concentrations of brighteners, the addition of various sulfinic acids or their salts has been recommended by Brown in U.S. Pat. No. 2,654,703; the use of organic hydroxy sulfonates has also been recommended by Passal in U.S. Pat. No. 3,697,391 for this purpose.

Unfortunately these compounds severely reduce the deposit leveling and bright range.

Further attempts have been made to improve low current density characteristics when "powerful" brighteners or high concentrations of brighteners are used:

(i) The use of aromatic monoamines, aromatic polyamines, unsubstituted polyethylenepolyamine by Du Rose in U.S. Pat. No. 3,630,857.

(ii) The use of N-(3-sulfopropyl) pyridinium inner salts by Rosenberg in U.S. Pat. No. 3,862,019.

(iii) The use of N-disubstituted amino propyne or its hydrochloride by Law in U.S. Pat. No. 4,054,495.

While these compounds do improve low current density characteristics, they still do not produce low current density deposits which are free from darkness and skip plate.

It is an object of this invention to provide processes and compositions for depositing electrodeposits of nickel which possess a greater tolerance for "powerful" brighteners and high concentrations of brighteners. It is also an object of this invention to accomplish this tolerance without affecting the leveling of the deposits. It is further an object of this invention to accomplish this tolerance while providing low current areas free from darkness and skip plate without affecting the bright range.

DESCRIPTION OF THE INVENTION

In accordance with certain of its aspects this invention relates to a process and composition for the preparation of a nickel electrodeposit, which comprises passing current from an anode to a cathode through an aqueous acidic electroplating solution containing at least one member selected from nickel compounds; the improvement comprising the presence of (i) an acetylenic amine or substituted amine, aliphatic or aromatic; and (ii) a sulfonated acetylenic and salts thereof where the acetylenic bond and the sulfonate radical are connected by a carbon chain where C=1–6;

for a time period sufficient to form a metal electroplate upon said cathode.

The concentrations of said compounds may be:

(i) acetylenic amine or substituted acetylenic amine, aliphatic or aromatic—0.005–0.1 g/l (ii) sulfonated acetylenics and salts thereof—0.005–0.25 g/l with a preferred range of:

(i) acetylenic amine or substituted acetylenic amine, aliphatic or aromatic—0.01–0.04 g/l (ii) sulfonated acetylenics and salts thereof—0.01–0.10 g/l.

Examples of acetylenic amines and substituted acetylenic amines of this invention, but not restricted to, are:

4-diethylamino-2-butyn-1-Ol
1,6-bis-(diethylamino)-2-hexyne
1-dimethylamino-2-propyne
N-methylpropargyl amine
propargyl amine
1-diethylamino-2-propyne
5-dimethylamino-2-methyl-3-pentyn-2-Ol
1-dimethylamino-2-pentyne
3-methylamino-1-butyne
1-dimethylamino-2-hexyne
1-dimethylamino-2-butyne
1-diethylamino-2-butyne
1-diethylamino-2-hexyne
4-diethylamino-1-butyne
4-diethylamino-2-pentyn-4-Ol
1,6-bis(morpholino)-2-hexyne
6-diethylamino-1-piperidino-2-hexyne Examples of sulfonated acetylenics of this invention, but not restricted to, are:

2-butyne-1,4-disulfonic acid
2-butyne sulfonic acid
propargyl sulfonic acid
1-butyne sulfonic acid
1-pentyne sulfonic acid The baths of this invention may also contain an effective amount of at least one member selected from the group consisting of:

(a) Class I brighteners
(b) Class II brighteners
(c) Anti-pitting or wetting agents The term "Class I brighteners" as used herein, and as described in *Modern Electroplating*, Third Edition, F. Lowenheim, Editor, is meant to include aromatic sulfonates, sulfonamides, sulfonimides, etc., as well as aliphatic or aromatic-aliphatic olefinically unsaturated sulfonates, sulfonamides, sulfonimides, etc. Specific examples of such plating additives are:

(1) sodium o-sulfobenzimide
(2) disodium 1,5-naphthalene trisulfonate
(3) trisodium 1,3,6-naphthalene trisulfonate (4) sodium benzene monosulfonate
(5) dibenzene sulfonimide
(6) sodium 3-chloro-2-butene-1-sulfonate
(7) sodium β-styrene sulfonate
(8) monoallyl sulfamide
(9) diallyl sulfamide
(10) allyl sulfonamide Such plating additive compounds, which may be used singly or in suitable combinations, are desirably employed in amounts ranging from about 0.5 to 10 grams per liter and provide the advantages described in the above reference and which are well known to those skilled in the art of nickel electroplating.

The term "Class II brighteners" as used herein, and as described in *Modern Electroplating*, Third Edition, F. Lowenheim, Editor, is meant to include plating additive compounds such as reaction products of epoxides with alphahydroxy acetylenic alcohols such as diethoxylated 2-butyne-1,4-diol or dipropoxylated 2-butyne-1,4-diol, other acetylenics, N-heterocyclics, dye-stuffs, etc.

Specific examples of such plating additives are:
(1) 1,4-di-(β-hydroxyethoxy)-2-butyne
(2) 1,4-di-(β-hydroxy-γ-chloropropoxy)-2-butyne
(3) 1,4-di-(β-, γ-epoxypropoxy)-2-butyne
(4) 1,4-di-(β-hydroxy-γ-butenoxy)-2-butyne
(5) 1,4-di-(2'-hydroxy-4'-oxa-6'-heptenoxy)-2-butyne
(6) N-(2,3-dichloro-2-propenyl)-pyridinium chloride
(7) 2,4,6-trimethyl N-propargyl pyridinium bromide
(8) N-allylquinaldinium bromide
(9) 2-butyne-1,4-diol
(10) propargyl alcohol
(11) 2-methyl-3-butyn-2-ol
(12) quinaldyl-N-propanesulfonic acid betaine
(13) quinaldine dimethyl sulfate
(14) N-allylpyridinium bromide
(15) isoquinaldyl-N-propanesulfonic acid betaine
(16) isoquinaldine dimethyl sulfate
(17) N-allylisoquinaldine bromide
(18) 1,4-di-(β-sulfoethoxy)-2-butyne
(19) 3-(β-hydroxyethoxy)-propyne
(20) 3-(β-hydroxypropoxy)-propyne
(21) 3-(β-solfoethoxy)-propyne
(22) phenosafranin
(23) fuchsin When used alone or in combination, desirably in amounts ranging from about 5 to 1000 milligrams per liter, a Class II brightener may produce no visual effect on the electrodeposit, or may produce semi-lustrous, fine-grained deposits. However, best results are obtained when Class II brighteners are used with one or more Class I brighteners in order to provide optimum deposit luster, rate of brightening, leveling, bright plate current density range, low current density coverage, etc.

The term "anti-pitting or wetting agents" as used herein is meant to include a material which functions to prevent or minimize gas pitting. An anti-pitting agent, when used alone or in combination, desirably in amounts ranging from about 0.05 to 1 gram per liter, may also function to make the baths more compatible with contaminants, such as oil, grease, etc. by their emulsifying, dispersing, solubilizing, etc. action on such contaminants and thereby promote attaining of sounder deposits. Preferred anti-pitting agents may include sodium lauryl sulfate, sodium lauryl ether-sulfate and sodium dialkylsulfosuccinates.

The nickel compounds employed for electrodepositing nickel are typically added as the sulfate, chloride, sulfamate, or fluoborate salts. The sulfate, chloride, sulfamate and fluoborate salts of nickel are employed in concentrations sufficient to provide nickel in the electroplating solutions of this invention in concentrations ranging from about 10 to 150 grams per liter.

The nickel electroplating baths of this invention additionally may contain from about 30 to 60 grams per liter, preferably about 45 grams per liter of boric acid or other buffering agents to control the pH (e.g.; from about 3.5–4.5, preferably 4.0) and to prevent high current density burning.

In order to prevent "burning" of high current density areas, and provide for more even temperature control of the solution, solution agitation may be employed. Air agitation, mechanical stirring, pumping, cathode rod and other means of solution agitation are all satisfactory. Additionally, the solutions may be operated without agitation.

The operating temperature of the electroplating baths of this invention may range from about 40° C. to about 70° C., preferably from about 50° C. to 62° C.

The average cathode current density may range from about 0.5 to 12 amperes per square decimeter, with 3 to 6 amperes per square decimeter providing an optimum range.

Typical aqueous nickel-containing electroplating solutions (which may be used in combination with effective amounts of cooperating additives) include the following wherein all concentrations are in grams per liter (g/l) unless otherwise indicated.

TABLE I

Aqueous Nickel-Containing Electroplating Solutions

| | Minimum | Maximum | Preferred |
|---|---|---|---|
| Component: | | | |
| $NiSO_4.6H_2O$ | 75 | 500 | 300 |
| $NiCl_2.6H_2O$ | 20 | 135 | 60 |
| $H_3BC_3$ | 30 | 60 | 45 |
| pH (electrometric) | 3.5 | 4.5 | 4.0 |

During bath operation, the pH may normally tend to rise and may be adjusted with acids such as hydrochloric acid, sulfuric acid, etc.

Anodes used in the above baths may be electrolytic or sulfur containing nickel bars, strips or small chunks in titanium baskets. All anodes are usually suitably covered with cloth or plastic bags of desired porosity to minimize introduction into the bath of metal particles, anode slime, etc. which may migrate to the cathode either mechanically or electrophoretically to give roughness in cathode deposits.

The substrates on which the nickel electrodeposits of this invention may be applied may be metal or metal alloys such as are commonly electrodeposited and used in the art of electroplating such as nickel, cobalt, nickel-cobalt, copper, tin, brass, etc. Other typical substrate basis metals from which articles to be plated are manufactured may include ferrous metals such as iron, steel, alloy steels, copper, tin and alloys thereof such as with lead, alloys of copper such as brass, bronze, etc., zinc, particularly in the form of zinc-base die castings; all of which may bear plates of other metals, such as copper, etc. Basis metal substrates may have a variety of surface finishes depending on the final appearance desired, which in turn depends on such factors as luster, brilliance, leveling, thickness, etc. of the nickel electroplate applied on such substrates.

While nickel electrodeposits can be obtained employing the various parameters described above, the brightness, leveling, ductility and covering power may not be sufficient or satisfactory for a particular application. In addition the deposits may be hazy or dull, and also exhibit striations, step plate, peeling, poor bright range or poor chromium receptivity. These conditions may especially result after the addition of excessive replenishment amounts of Class II brighteners, or from the use of especially powerful Class II brighteners.

The addition or inclusion of specified amounts of (i) an acetylenic amine, or substituted acetylenic amine, aliphatic or aromatic and (ii) a sulfonated acetylenic compound and salts thereof, where the acetylenic bond and the sulfonate radical are connected by a carbon chain where C=1-6 to an aqueous acidic nickel electroplating bath will correct the aforementioned deficiencies.

Additionally when used together, compounds from these classes will permit the use of higher than normal concentrations of Class II brighteners, thus permitting higher rates of brightening and leveling without the undesirable striations, skip plate, poor bright range, etc. normally expected under these conditions.

Compounds from the two classes of this invention are unusual in that they act synergistically together to produce sound low current density deposits free from darkness, striations, skip plate, etc. without affecting leveling or the bright range of the electrodeposit in the presence of "powerful" or high concentrations of Class II brighteners. These compounds when used independent of one another and in the presence of "powerful" or high concentrations of Class II brighteners still produce electrodeposits exhibiting one or more of the following effects: low current density darkness, striations, skip plate, poor bright range.

The concentrations of the compounds in the invention are:

(i) acetylenic amine or substituted acetylenic amine, aliphatic or aromatic—0.005-0.1 g/l (ii) sulfonated acetylenic compound and salts thereof, where the acetylenic bond and the sulfonate radical are connected by a carbon chain where C=1-6, —0.005-0.25 g/l with the preferred concentrations being:

(i) acetylenic amine or substituted acetylenic amine, aliphatic or aromatic 0.01-0.04 g/l (ii) sulfonated acetylenic compound and salts thereof, when the acetylenic bond and the sulfonate radical are connected by a carbon chain where C=1-6 0.01-0.10 g/l.

The following examples are presented as an illustration to provide those skilled in the art of electroplating, a better understanding of the various embodiments and aspects of this invention. These examples should not be construed as limiting the scope of the invention in any way.

TABLE II

| | Compositions in g/l | | | | |
|---|---|---|---|---|---|
| | Panel 1 | Panel 2 | Panel 3 | Panel 4 | Panel 5 |
| $NiSO_4.6H_2O$ | 300 | 300 | 300 | 300 | 300 |
| $NiCl_2.6H_2O$ | 60 | 60 | 60 | 60 | 60 |
| $H_3BO_3$ | 45 | 45 | 45 | 45 | 45 |
| pH | 4.0 | 4.0 | 4.0 | 4.0 | 4.0 |
| temperature | 60° C. | 60° C. | 60° C. | 60° C. | 60° C. |
| sodium o-sulfo-benzimide | 1.35 | 1.35 | 1.35 | 1.35 | 1.35 |
| propargyl alcohol | 0.005 | 0.005 | 0.005 | 0.01 | 0.005 |
| monoethoxylated propargylalcohol | 0.01 | 0.01 | 0.01 | 0.01 | 0.01 |
| 1-diethylamino-2-propyne | Nil | 0.02 | 0.025 | Nil | 0.02 |
| sodium salt of propargylsulfonic acid | Nil | 0.1 | 0.05 | 0.15 | 0.02 |
| 2-butyne-1,4-diol | Nil | Nil | 0.02 | Nil | Nil |
| 4-diethylamino-2-pentyn-4-ol | Nil | Nil | Nil | 0.01 | Nil |

The conditions for plating the panels from the above aqueous nickel electroplating compositions were as follows: A zinc coated steel panel was stripped in 50% hydrochloric acid, rinsed, and then scribed with a horizontal single pass of 4/0 grit emery polishing paper and 2 grit emery polishing paper. The cleaned panel was then plated in a 267 ml Hull Cell using the aforementioned compositions for 10 minutes at 2 amperes cell current, using cathode rocker agitation.

OBSERVATIONS

Panel #1—shows a ductile deposit with fair brightness and leveling, low current density darkness, skip plate, hazing at 2-4 asf and a thin plate area at 0-1½ asf.

Panel #2—shows a bright well leveled, ductile deposit free from low current density defects and a uniform bright range.

Panel #3—shows a ductile deposit with good brightness and leveling, excellent bright range, freedom from low current density darkness and skip plate.

Panel #4—shows a ductile deposit with good brightness and leveling, good bright range and freedom from low current density darkness and skip plate.

Panel #5—shows a ductile deposit with good brightness and leveling, uniform bright range, and freedom from low current density defects.

Although this invention has been illustrated by reference to specific embodiments, modifications thereof which are clearly within the scope of the invention will be apparent to those skilled in the art.

What is claimed is:

1. An aqueous acidic electroplating solution for use in electrodepositing nickel from a nickel compound containing solution, wherein said solution comprises:

(a) a nickel compound;

(b) 0.005 gram per liter to 0.1 gram per liter of an acetylenic amine or substituted amine, aliphatic or aromatic; and (c) 0.01 gram per liter to 0.10 gram per liter of a sulfonated acetylenic and salts thereof where the acetylenic bond and the sulfonate radical are connected by a carbon chain where C=1-6.

2. The process of claim 1 wherein said acetylenic amine is 4-diethylamino-2-butyn-1-Ol.

3. The process of claim 1 wherein said acetylenic amine is 1,6-bis-(diethylamino)-2-hexyne.

4. The process of claim 1 wherein said acetylenic amine is 1-dimethylamino-2-propyne.

5. The process of claim 1 wherein said acetylenic amine is N-methylpropargyl amine.

6. The process of claim 1 wherein said acetylenic amine is propargyl amine.

7. The process of claim 1 wherein said acetylenic amine is 1-diethylamino-2-propyne.

8. The process of claim 1 wherein said acetylenic amine is 5-dimethylamino-2-methyl-3-pentyn-2-Ol.

9. The process of claim 1 wherein said acetylenic amine is 1-dimethylamino-2-pentyne.

10. The process of claim 1 wherein said acetylenic amine is 3-methylamino-1-butyne.

11. The process of claim 1 wherein said acetylenic amine is 1-dimethylamino-2-hexyne.

12. The process of claim 1 wherein said acetylenic amine is 1-dimethylamino-2-butyne.

13. The process of claim 1 wherein said acetylenic amine is 1-diethylamino-2-butyne.

14. The process of claim 1 wherein said acetylenic amine is 1-diethylamino-2-hexyne.

15. The process of claim 1 wherein said acetylenic amine is 4-diethylamino-1-butyne.

16. The process of claim 1 wherein said acetylenic amine is 4-diethylamino-2-pentyn-4-Ol.

17. The process of claim 1 wherein said acetylenic amine is 1,6-bis(morpholino)-2-hexyne.

18. The process of claim 1 wherein said acetylenic amine is 6-diethylamino-1-piperidino-2-hexyne.

19. The process of claim 1 wherein said sulfonated acetylenic is 2-butyne-1,4-disulfonic acid.

20. The process of claim 1 wherein said sulfonated acetylenic is 2-butyne sulfonic acid.

21. The process of claim 1 wherein said sulfonated acetylenic is propargyl sulfonic acid.

22. The process of claim 1 wherein said sulfonated acetylenic is 1-butyne sulfonic acid.

23. The process of claim 1 wherein said sulfonated acetylenic is 1-pentyne sulfonic acid.

24. The method of electroplating nickel comprising the step of passing current from an anode to a cathode through the aqueous acidic electroplating solution of claim 1.

25. The composition of claim 24 wherein said acetylenic amine is 4-diethylamino-2-butyn-1-Ol.

26. The composition of claim 24 wherein said acetylenic amine is 1,6-bis-(diethylamino)-2-hexyne.

27. The composition of claim 24 wherein said acetylenic amine is 1-dimethylamino-2-propyne.

28. The composition of claim 24 wherein said acetylenic amine is N-methylpropargyl amine.

29. The composition of claim 24 wherein said acetylenic amine is propargyl amine.

30. The composition of claim 24 wherein said acetylenic amine is 1-diethylamino-2-propyne.

31. The composition of claim 24 wherein said acetylenic amine is 5-dimethylamino-2-methyl-3-pentyn-2-Ol.

32. The composition of claim 24 wherein said acetylenic amine is 1-dimethylamino-2-pentyne.

33. The composition of claim 24 wherein said acetylenic amine is 3-methylamino-1-butyne.

34. The composition of claim 24 wherein said acetylenic amine is 1-dimethylamino-2-hexyne.

35. The composition of claim 24 wherein said acetylenic amine is 1-dimethylamino-2-butyne.

36. The composition of claim 24 wherein said acetylenic amine is 1-diethylamino-2-butyne.

37. The composition of claim 24 wherein said acetylenic amine is 1-diethylamino-2-hexyne.

38. The composition of claim 24 wherein said acetylenic amine is 4-diethylamino-1-butyne.

39. The composition of claim 24 wherein said acetylenic amine is 4-diethylamino-2-pentyn-4-Ol.

40. The composition of claim 24 wherein said acetylenic amine is 1,6-bis(morpholino)-2-hexyne.

41. The composition of claim 24 wherein said acetylenic amine is 6-diethylamino-1-piperidino-2-hexyne.

42. The composition of claim 24 wherein said sulfonated acetylenic is 2-butyne-1,4-disulfonic acid.

43. The composition of claim 24 wherein said sulfonated acetylenic is 2-butyne sulfonic acid.

44. The composition of claim 24 wherein said sulfonated acetylenic is propargyl sulfonic acid.

45. The composition of claim 24 wherein said sulfonated acetylenic is 1-butyne sulfonic acid.

46. The composition of claim 24 wherein said sulfonated acetylenic is 1-pentyne sulfonic acid.

* * * * *